US005664442A

United States Patent [19]

Andó

[11] Patent Number: 5,664,442

[45] Date of Patent: Sep. 9, 1997

[54] ELASTIC SELECTOR WITH ASSOCIATED SUB-NEEDLE FOR NEEDLES IN A CIRCULAR KNITTING MACHINE

[75] Inventor: Jan Andó, Scandicci, Italy

[73] Assignee: Matec S.r.l., Scandicci, Italy

[21] Appl. No.: 611,509

[22] Filed: Mar. 6, 1996

[30] Foreign Application Priority Data

Mar. 30, 1995 [IT] Italy ..... BO95A0142

[51] Int. Cl.[6] ..... D04B 9/00

[52] U.S. Cl. ..... 66/220; 66/219; 66/75.2

[58] Field of Search ..... 66/215, 216, 217, 66/218, 219, 220

[56] References Cited

U.S. PATENT DOCUMENTS 3,710,594 1/1973 Bourgeois ..... 66/220
4,715,198 12/1987 Ploppa et al. ..... 66/219 X
4,905,484 3/1990 Schindler ..... 66/220
5,520,024 5/1996 Andó ..... 66/220

*Primary Examiner*—John J. Calvert
*Attorney, Agent, or Firm*—Welsh & Katz, Ltd.

[57] ABSTRACT

The selector has a lower extension for retention by a fixed magnetic selection ring associated with a needle cylinder, and an upper shaped elastic portion for returning the lower portion of the selector towards the outside of a needle cylinder. A flat or inclined profile is defined uppermost on the selector for engagement with a correspondingly flat or inclined base of a sub-needle. A guide portion, having a longitudinal extension lying substantially parallel to the shaped elastic portion, is connected to the shaped elastic portion and is engageable with helical springs used for retaining selectors in needle cylinder grooves. The selector has an upper heel protruding therefrom at an opposite side with respect to said guide portion, and a lower heel extending parallel to the upper heel for engagement with a lifting cam.

18 Claims, 2 Drawing Sheets

ELASTIC SELECTOR WITH ASSOCIATED SUB-NEEDLE FOR NEEDLES IN A CIRCULAR KNITTING MACHINE

BACKGROUND OF THE INVENTION

The present invention relates to an elastic selector with associated sub-needle for needles in a circular knitting machine.

Conventional circular knitting machines for manufacturing socks, stockings, tubular products having even large diameters, and the like, have a cylinder with a usually vertical axis that is affected by a plurality of longitudinal peripheral millings, in which respective needles, sub-needles, and selectors are mounted so as to be vertically slideable.

In order to modify the characteristics of the product being knitted, it is necessary to raise certain needles by a certain extent during the rotation of the cylinder, and at very specific angular positions; this is achieved by means of selectors that are actuatable by respective cam profiles for upward or downward movement.

Most conventional devices select the selectors by compressing them towards the inside of the cylinder, thereby necessitating additional preselection cams for extracting all the selectors in their seats towards the outside of the cylinder prior to actual selection, with the result of reducing the angular portion available for selection owing to the presence of the extraction cams.

In some machines provisions have been made to retain all the selectors against a magnetic ring arranged inside the cylinder and to release, by means of localized magnetic pulses, only the selectors to be selected. Upon being released, said selectors return elastically outward with their heels in the configuration for engaging lifting cams.

The production of such machines with retention against an internal magnetic ring and release towards the outside has led to the need to provide particular elastic selectors with corresponding sub-needles adapted to meet any operating requirement of circular knitting machines.

The movement of the magnetic selector retention ring inside the cylinder, the small space occupation of the electromagnetic release points, and the complete range of elastic selectors and associated sub-needles allow to considerably reduce the space occupations linked to the provision of the selection points land to simplify the machine.

SUMMARY OF THE INVENTION

A principal aim of the present invention is to provide an elastic selector with associated sub-needle for needles in a circular knitting machine that allows to select the needles at will, according to requirements, and without having to modify or replace other parts of the machine.

An object of the present invention is to provide an elastic selector with associated sub-needle for needles in a circular knitting machine that has a reduced bulk and allows very precise selection.

Within the scope of this aim, another object of the present invention is to achieve the above aim and object with a structure that is simple, relatively easy to manufacture, safe in use, effective in operation, and has a relatively low cost.

With this aim and these objects in view, there is provided an elastic selector with associated sub-needle for needles in a circular knitting machine, characterized in that the selector is provided, in a downward region, with a tapering extension adapted to be retained by a fixed magnetic selection ring arranged towards the inside of a needle cylinder; and upwardly defines a shaped elastic portion which is folded back and is adapted to return the lower portion toward the outside of the needle cylinder; said selector having a top defining a profile for engagement with the base of said sub-needle, said profile being flat or inclined substantially at 45 degrees to cooperate with said base of said sub-needle, which has, in an intermediate position, a return and lifting heel and a flat base or, for the oscillating sub-needle, a bat that is inclined and provided with at least one heel.

BRIEF DESCRIPTION OF THE DRAWINGS

Further characteristics and advantages of the present invention will become apparent from the following detailed description of preferred but not exclusive embodiments of an elastic selector with associated sub-needle for needles in a circular knitting machine according to the invention, illustrated only by way of non-limitative example in the accompanying drawings, wherein.

DESCRIPTION OF THE PREFERRED EMBODIMENTS

Figure 1A:
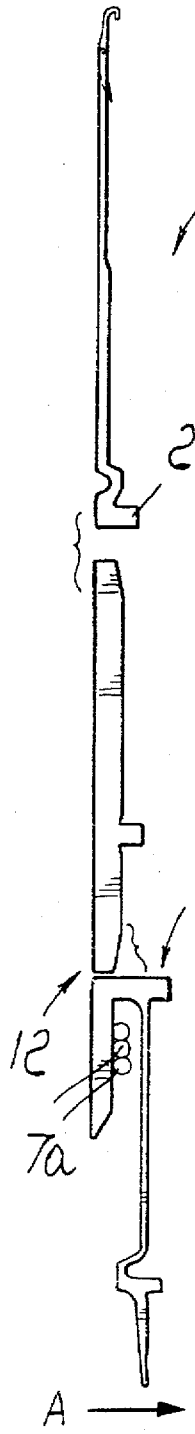
FIGS. 1*a* and 1*b* are schematic side views of an elastic selector with associated sub-needle for needles in a circular knitting machine according to the invention, in various operating configurations.

With particular reference to the above figures, the reference numeral 1 designates an elastic selector, the reference numeral 2 designates a sub-needle, and the reference numeral 3 designates a needle in a circular knitting machine according to the invention; the reference numeral 4 designates a sinker.

The selectors and the needles are mounted in a conventional manner at respective longitudinal millings that are distributed over the lateral surface of the cylinder of the machine.

The elastic selector 1 is provided, in a downward region, with a thinned or tapering extension 5 adapted to be retained by a fixed magnetic selection ring arranged towards the inside of the cylinder; in an upward region, with an elongated elastic portion 6 adapted to return the lower portion towards the outside of the cylinder an with a portion 7 substantially parallel to the portion 6 and adapted to be retained and guided vertically n the longitudinal millings of the cylinder: elastic rings 7*a* act on the portion 7 and are constituted by helical traction springs that are closed in a loop and keep the portion 7 pressed against the bottom of the respective guiding groove of the cylinder in order to prevent vibration during the manufacture of the product: the elastic portion 6 is adapted to return the lower extension 5 towards the outside of the cylinder (arrow A).

The selector is provided with a heel 8 in a downward region and with a heel 9 in an upward region; the lower heel 8 is elastically returned outwards in a position for being engaged by a lifting cam or for being retained towards the cylinder axis in a configuration in which there is no interference with said cam.

The sub-needle 2 has, in a median position, a heel 10 for lifting and lowering the sub-needle which, in the case of an oscillating sub-needle, can act as a fulcrum for the oscillation of the sub-needle.

Figure 1B:
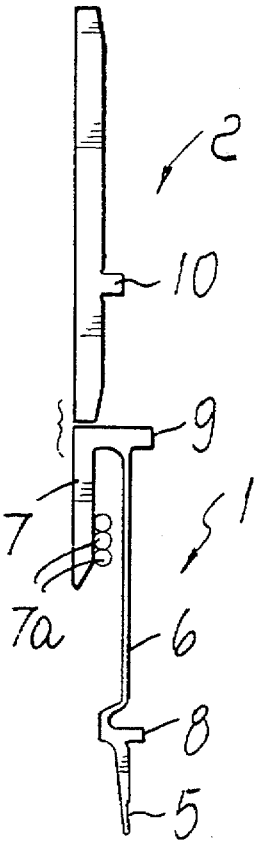

In the embodiment illustrated in FIGS. 1*a* and 1*b*, with a sub-needle that does not oscillate, the profile 11 at the top of the selector 1 is flat to cooperate with the flat base profile 12 of the sub-needle.

In the embodiments illustrated in FIGS. 2*a*–2*b* and 3*a*–3*c*, the profiles 13 and 14 defined at the top of the selector are inclined substantially at 45 degrees and have varying lengths to cooperate with the bases 15 and 16 of the sub-needle, which are inclined at 45 degrees.

Figure 2A:
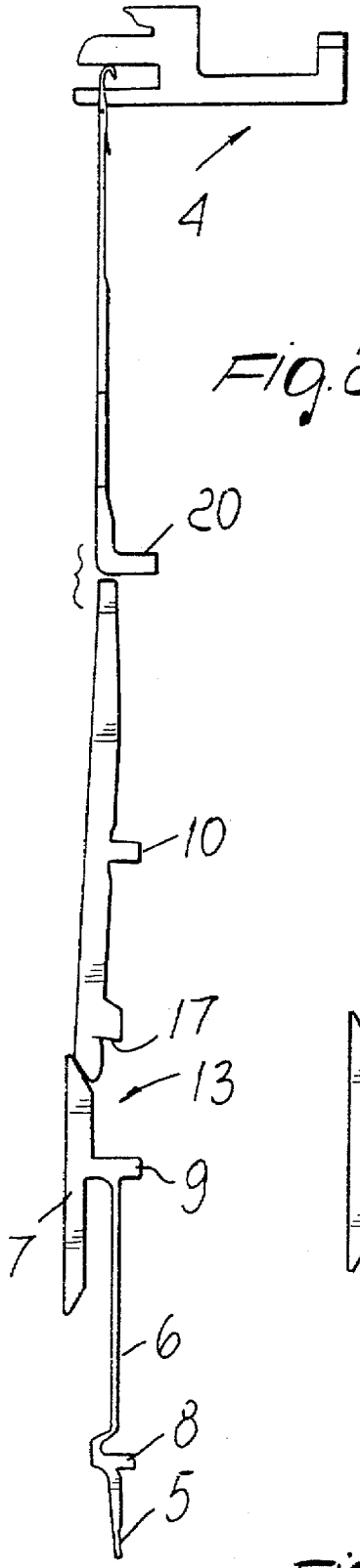
FIGS. 2*a* and 2*b* are schematic side views of a selector with an oscillating sub-needle in another embodiment, in different operating configurations.
Figure 2B:
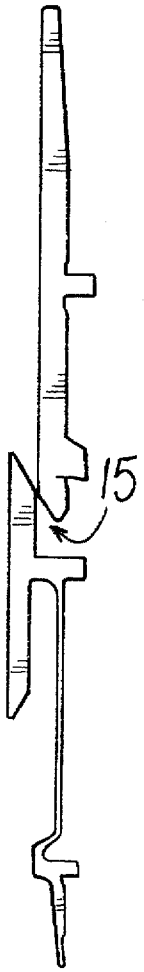
Figure 3A:
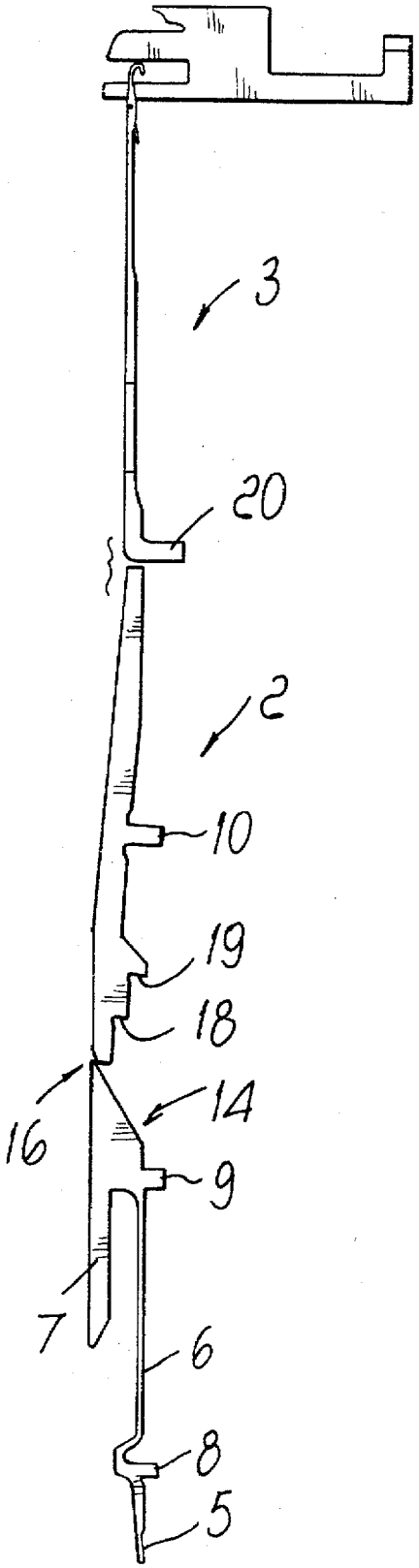
FIGS. 3*a*, 3*b* and 3*c* are schematic side views of a selector with oscillating sub-needle in a further embodiment, in different operating configurations.
Figure 3B:
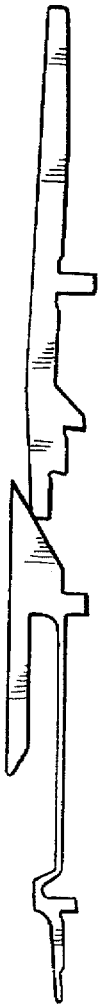
Figure 3C:
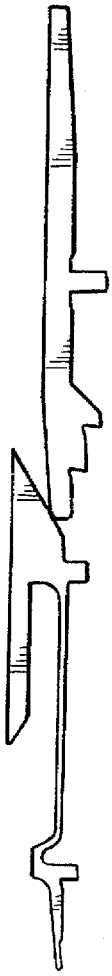

In the embodiment shown in FIGS. 2*a*–2*b*, the base of the sub-needle has a heel 17, whereas in the example of FIGS. 3*a*–3*c*, the base of the sub-needle has two heels 18 and 19.

In FIG. 1*a*, the selector has been shown in the lowered position and in the raised position in FIG. 1*b*, in which the sub-needle is accordingly in the condition in which the needle is active; in FIG. 2*a*, the selector has been shown in the lowered position, and in the raised position in FIG. 2*b*, and accordingly in FIG. 2*b* the sub-needle is in the configuration for affecting the corresponding cam that produces transfer to the position in which the needle is active, whereas in FIG. 2*a*, it is in the condition in which no interference occurs with the cam; in FIG. 3*a*, the selector has been shown in the lowered position, partially raised in position in FIG. 3*b*, and fully raised in position in FIG. 3*c*; accordingly, in FIG. 3*b* the heel 18 is affected by the corresponding cam, which moves the needle to the casting-off position, in FIG. 3*c* the heel 19 is affected by the respective cam, which moves the needle to the stitch retention position, whereas in FIG. 3*a* the sub-needle is not affected by the lifting cams. The lowering of the sub-needle is produced by a lowering cam that acts on the heel 10, whereas the lowering of the needle occurs by acting on the corresponding heel 20.

The operation of the selection device according to the invention is as follows: during rotation of the cylinder, the selectors, according to requirements, can be selected and therefore released elastically outwards; by means of the heel 8, the selected selector is raised by the respective cam and, depending on the execution of the profiles of the cams whereon the heel of the sub-needle 10 and the heel of the needle 20 engage, the corresponding needle can be moved to the stitch retention level, to the casting-off level, or to any other necessary level.

It is also noted that the device according to the invention is very compact in size and occupies little space; it also allows to perform any kind of selection on any needle, allowing any kind of work on the same machine.

The invention thus conceived is susceptible of numerous modifications and variations, all of which are within the scope of the inventive concept.

All the details may furthermore be replaced with other technically equivalent ones.

In practice, the materials employed, as well as the shapes and the dimensions, may be any according to the requirements without thereby abandoning the scope of the protection of the appended claims.

What is claimed is:

1. An elastic selector in combination with a sub-needle for needles in a circular knitting machine, said elastic selector comprising:

a tapering extension for being selectively magnetically retained and being arranged at a downward end of the elastic selector;

an elongated elastic portion extending upwardly from said downward end;

a top connected to said elongated elastic portion and defining a profile engaged with a base of said sub-needle; and a folded-back portion extending downwardly from said top, said elongated elastic portion being elastically deformable with respect to said folded-back portion such as to be movable towards and away from said folded-back portion.

2. The combination of claim 1, wherein said folded-back portion extends substantially parallel to said elongated elastic portion when said elongated elastic portion is not elastically deformed towards said folded-back portion.

3. An elastic selector in combination with a needle element in a circular knitting machine, said selector comprising:

a lower portion defining a thinned extension for being selectively magnetically retained;

an upper portion defining a shaped elastic portion extending from said lower portion;

a profile defined uppermost on said selector engaged with a base of said needle element in which said base is shaped correspondingly with respect to said profile defined uppermost on said selector; and a guide portion extending downwardly from said profile, said shaped elastic portion being elastically deformable with respect to said guide portion so as to be movable towards and away from said guide portion.

4. The combination of claim 3, wherein said guide portion has a longitudinal extension lying substantially parallel to said shaped elastic portion.

5. The combination of claim 4, wherein said selector has at least one upper heel protruding from said selector at an opposite side thereof with respect to said guide portion, and at least one lower heel protruding from said selector at an opposite side thereof with respect to said guide portion, said lower heel extending parallel to said upper heel, substantially orthogonally with respect to said longitudinal extension of said guide portion, for engagement with a lifting cam.

6. The combination of claim 3, wherein said needle element has a flat base, and wherein said profile defined uppermost on said selector comprises a flat surface for engagement with said flat base of said needle element.

7. The combination of claim 3, wherein said needle element comprises an inclined base and said profile being a correspondingly inclined profile defined uppermost on said selector for engagement with said inclined base of said needle element, at least one heel being connected to said base of said needle element.

8. The combination of claim 7, wherein said inclined base and profile are inclined substantially at 45 degrees.

9. The combination of claim 7, further comprising at least one casting-off heel connected to said base of said needle element, and at least one stitch retention heel connected to said base of said needle element above said casting-off heel.

10. The combination of claim 9, wherein said casting-off heel and said stitch retention heel protrude from said base of said needle element in a direction substantially parallel to said return and lifting heel, said casting-off heel being shorter than said stitch retention heel.

11. An elastic selector in combination with a sub-needle for needles in a circular knitting machine, said selector comprising:

a lower portion defining a thinned extension for being selectively magnetically retained;

an upper portion defining a shaped elastic portion extending from said lower portion;

a profile defined uppermost on said selector engaged with a base of said sub-needle in which said base is shaped correspondingly with respect to said profile defined uppermost on said selector; and a guide portion extending downwardly from said profile, said shaped elastic portion being elastically deformable with respect to said guide portion so as to be movable towards and away from said guide portion.

12. The combination of claim 11, wherein said guide portion has a longitudinal extension lying substantially parallel to said shaped elastic portion.

13. The combination of claim 12, wherein said selector has at least one upper heel protruding from said selector at an opposite side thereof with respect to said guide portion, and at least one lower heel protruding from said selector at an opposite side thereof with respect to said guide portion, said lower heel extending parallel to said upper heel, substantially orthogonally with respect to said longitudinal extension of said guide portion, for engagement with a lifting cam.

14. The combination of claim 11, wherein said sub-needle has a flat base, and wherein said profile defined uppermost on said selector comprises a flat surface for engagement with said flat base of said sub-needle.

15. The combination of claim 11, wherein said sub-needle comprises an inclined base and said profile being a correspondingly inclined profile defined uppermost on said selector for engagement with said inclined base of said sub-needle, at least one heel being connected to said base of said sub-needle.

16. The combination of claim 15, wherein said inclined base and profile are inclined substantially at 45 degrees.

17. The combination of claim 15, further comprising at least one casting-off heel connected to said base of said sub-needle, and at least one stitch retention heel connected to said base of said sub-needle above said casting-off heel.

18. The combination of claim 17, wherein said casting-off heel and said stitch retention heel protrude from said base of said sub-needle in a direction substantially parallel to said return and lifting heel, said casting-off heel being shorter than said stitch retention heel.

* * * * *